United States Patent [19]

Shopsky

[11] Patent Number: 4,638,148

[45] Date of Patent: Jan. 20, 1987

[54] CONTROL SYSTEM AND CONTROL DEVICE FOR CONTROLLING A HEATING UNIT AND METHOD OF MAKING THE SAME

[75] Inventor: Harvey J. Shopsky, Latrobe, Pa.

[73] Assignee: Robertshaw Controls Company, Richmond, Va.

[21] Appl. No.: 709,889

[22] Filed: Mar. 8, 1985

Related U.S. Application Data

[63] Continuation of Ser. No. 534,340, Sep. 21, 1983, abandoned.

[51] Int. Cl.[4] ..... H05B 1/02

[52] U.S. Cl. ..... 219/497; 219/491; 219/513; 219/508; 337/1; 337/117; 338/40; 338/41

[58] Field of Search ..... 219/489, 400, 491, 494, 219/512, 513, 412, 413, 508, 391, 515; 337/1, 337/114, 117; 338/29, 31, 40, 41

[56] References Cited

U.S. PATENT DOCUMENTS

| | | | |
|---|---|---|---|
| 1,986,695 | 1/1935 | Warner | 338/40 |
| 2,195,813 | 4/1940 | De Giers | 338/40 |
| 2,248,672 | 7/1941 | Holmes | 338/31 |
| 3,412,236 | 11/1968 | Hild et al. | 219/512 |
| 4,323,764 | 4/1982 | Willison et al. | 219/497 |

*Primary Examiner*—M. H. Paschall

*Attorney, Agent, or Firm*—Candor, Candor & Tassone

[57] ABSTRACT

A control system and control device for controlling a heating unit and method of making the control device are provided, the control device having a rod and tube temperature sensing unit for providing linear motion of a part thereof along a substantially straight linear path in relation to the temperature being sensed by the temperature sensing unit and having a potentiometer unit provided with an electrical output producing unit operatively interconnected to the part of the temperature sensing unit so as to produce a variable electrical signal in relation to the temperature being sensed by the temperature sensing unit, the electrical output unit being movable along an arcuate linear path by the part of the temperature sensing unit. The potentiometer unit has a member provided with an arcuate surface, the electrical output unit being disposed in sliding engagement with the arcuate surface whereby the arcuate surface defines the arcuate path of movement of the electrical output unit. The member is movable relative to the device on an arcuate path that is substantially concentric to the arcuate path of movement of the electrical output unit for calibrating the device.

18 Claims, 17 Drawing Figures

CONTROL SYSTEM AND CONTROL DEVICE FOR CONTROLLING A HEATING UNIT AND METHOD OF MAKING THE SAME

CROSS REFERENCE TO RELATED APPLICATION

This application is a continuation patent application of its copending parent patent application, Ser. No. 534,340, filed Sept. 21, 1983, and now abandoned in favor of this continuation patent application.

FIELD OF THE INVENTION

This invention relates to an improved control system and control device for controlling the output temperature of a heating means as well as to a method of making such a control device.

PRIOR ART STATEMENT

It is known to applicant to provide a control system for a heating means that has control means for comparing a variable electrical signal that has a value in relation to the output temperature of the heating means and a selected electrical signal that has a value in relation to a selected temperature setting to control the operation of the heating means to tend to produce an output temperature substantially equal to the selected temperature, the control means comprising a control device having a rod and tube temperature sensing unit for providing linear motion of a part thereof along a substantially straight linear path in relation to the output temperature of the heating means and having a potentiometer means provided with an electrical output producing means operatively interconnected to the part of the unit so as to produce a variable electrical signal in relation to the output temperature of the heating means, the electrical output means being movable along an arcuate linear path by the part of the unit. The potentiometer means has a member provided with an arcuate surface means, the electrical output means being disposed in sliding engagement with the arcuate surface means whereby the arcuate surface means defines the arcuate path of movement of the electrical output means. For example, see the copending U.S. patent application Ser. No. 534,339, filed Sept. 21, 1983, now abandoned, of Siegfried E. Manecke et al.

SUMMARY OF THE INVENTION

It is one feature of this invention to provide an improved control device having a rod and tube temperature sensing unit for providing linear motion of a part thereof and having a potentiometer means provided with an electrical output producing means operatively interconnected to the part of the temperature sensing unit so as to produce a variable electrical signal in relation to the temperature being sensed by the unit.

In particular, it was found according to the teachings of this invention that when the control device is formed in the manner set forth in the aforementioned copending patent application, Ser. No. 534,339, filed Sept. 21, 1983, now abandoned, of Siegfried E. Manecke et al so that the means being utilized to translate the motion of the movable part of the rod of the rod and tube temperature sensing unit to the movable part of the potentiometer means to move in an arcuate path that is substantially coplanar with the substantially straight linear path of movement of the part of the rod and tube temperature sensing unit, the member of the potentiometer means that carries the electrical resistance means against which the output means slides should be made adjustable along an arcuate path that is substantially concentric to the arcuate path of movement of the electrical output means of the potentiometer means so that the device can be readily calibrated.

For example, one embodiment of this invention provides a control device having a rod and tube temperature sensing unit for providing linear motion of a part thereof along a substantially straight linear path in relation to the temperature being sensed by the unit and having a potentiometer means provided with an electrical output producing means operatively interconnected to the part of the unit so as to produce a variable electrical signal in relation to the temperature being sensed by the unit, the electrical output means being movable along an arcuate linear path by the part of the unit. The potentiometer means has a member provided with an arcuate surface means. The electrical output means is disposed in sliding engagement with the arcuate surface means whereby the arcuate surface means defines the arcuate path. The member is movable relative to the device along an arcuate path that is substantially concentric to the arcuate path of the electrical output means for calibrating the device.

Accordingly, it is an object of this invention to provide an improved control device having one or more of the novel features of this invention as set forth above or hereinafter shown or described.

Another object of this invention is to provide a method of making such a control device, the method of this invention having one or more of the novel features of this invention as set forth above or hereinafter shown or described.

Another object of this invention is to provide an improved control system utilizing such a control device, the control system of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
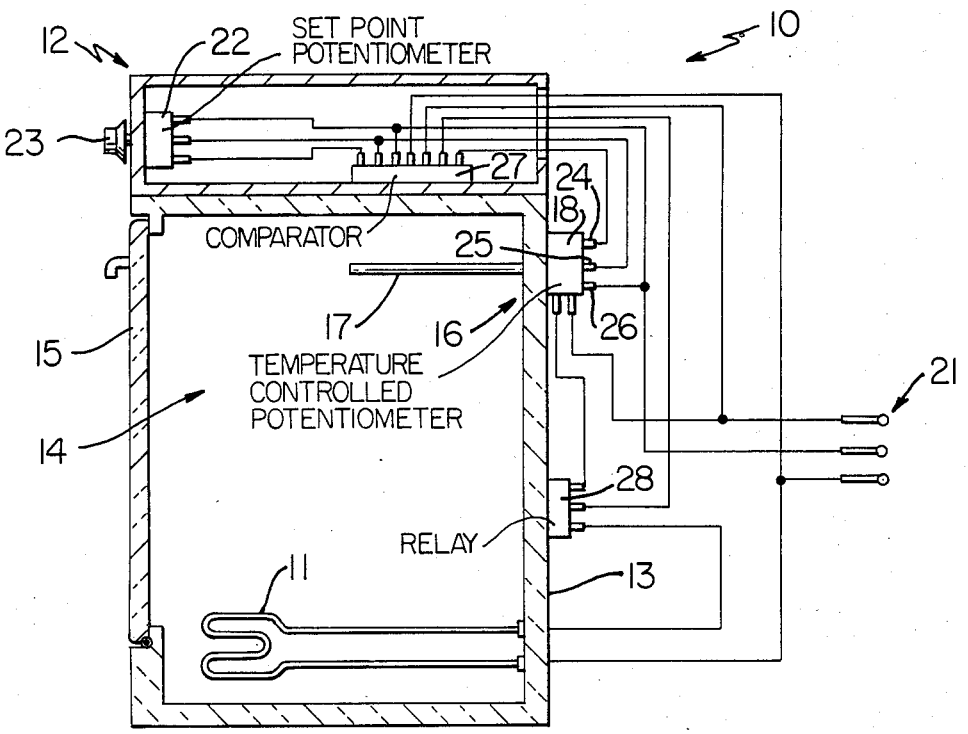
FIG. 1 is a schematic view illustrating the improved control system of this invention.
Figure 2:
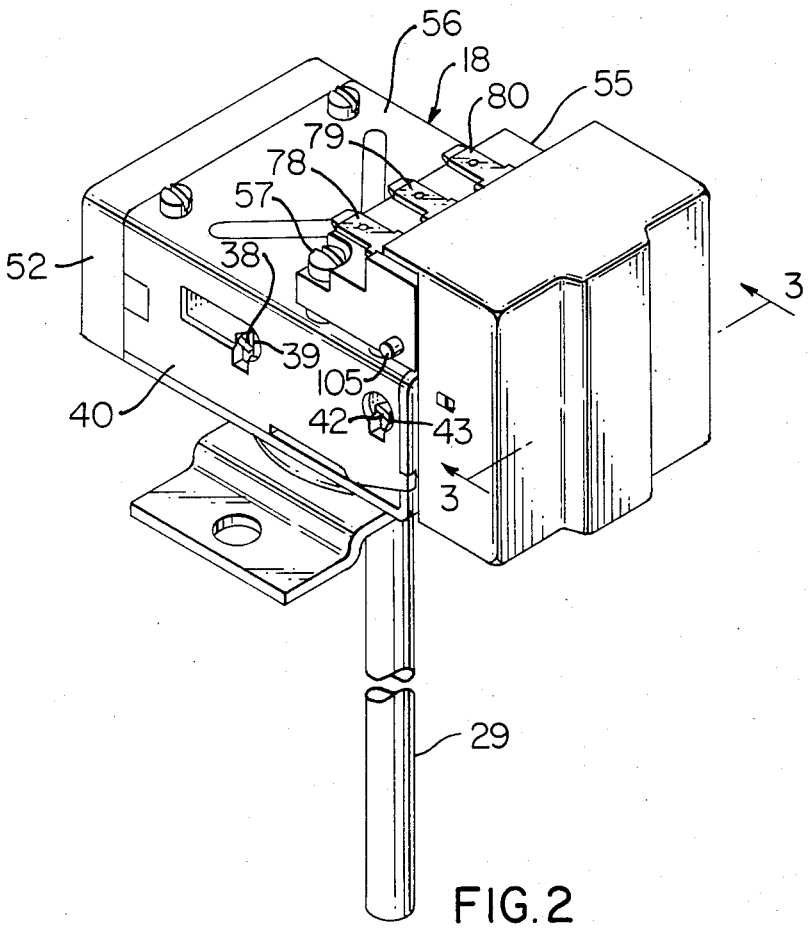
FIG. 2 is a perspective view illustrating the improved control device of this invention that is utilized in the control system of FIG. 1.
Figure 3:
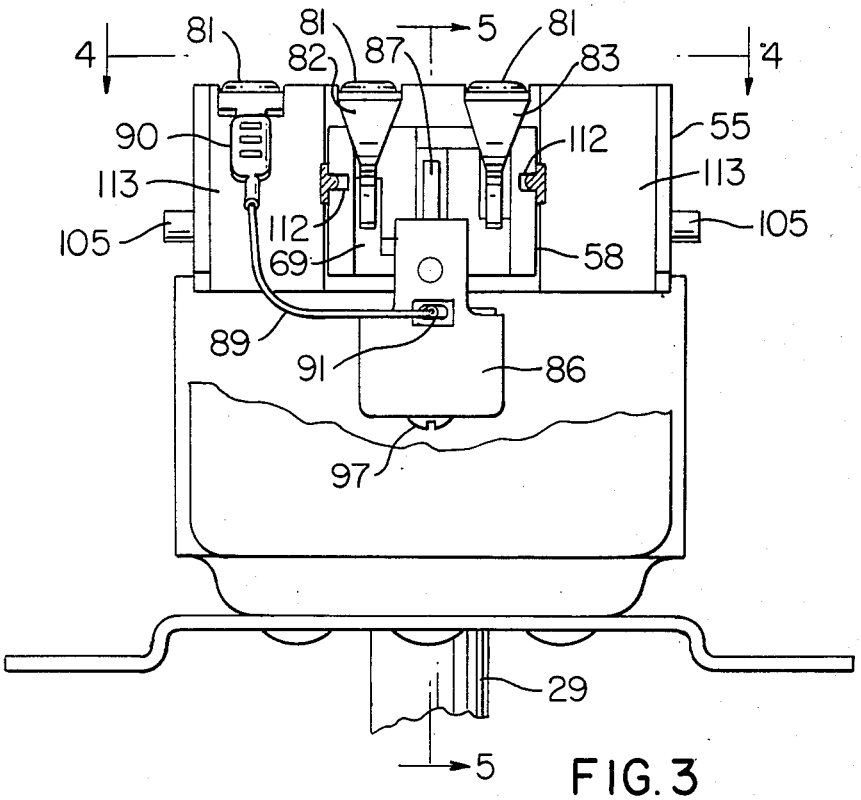
FIG. 3 is an enlarged end view, partially broken away, of the control device of FIG. 2 and is taken substantially in the direction of the arrows 3—3 of FIG. 2.

While the various features of this invention are hereinafter described and illustrated as being particularly adapted to provide a control means for the heating means of a cooking apparatus, it is to be understood that the various features of this invention can be utilized singly or in any combination thereof to provide control means for heater means of other types of apparatus as desired.

Therefore, this invention is not to be limited to only the embodiment illustrated in the drawings, because the drawings are merely utilized to illustrate one of the wide variety of uses of this invention.

Referring now to FIG. 1, the improved control system of this invention is generally indicated by the reference numeral 10 and is utilized for controlling the operation of an electrical heater unit or means 11 of a cooking apparatus that is generally indicated by the reference numeral 12 and comprises a frame means 13 having an oven cavity 14 provided therein that is to be heated by the heater means 11 and is provided with a conventional door means 15 for access thereto.

A control unit of this invention for the control system 10 is generally indicated by the reference numeral 16 in the drawings and comprises a rod and tube temperature sensing means 17 interconnected in a manner hereinafter set forth to a housing means 18 that contains an electrical switch means that is generally indicated by the reference numeral 19 in FIG. 5 and a potentiometer means that is generally indicated by the reference numeral 20 in FIG. 5.

As will be apparent hereinafter, the electrical switch means 19 is utilized as a high temperature limit switch to disconnect an electrical energy source that is generally indicated by the reference numeral 21 in FIG. 1 from the electrical heater means 11 should the temperature in the oven 14 exceed a safe high limit thereof. The potentiometer 20 of the control device 16 of this invention, in a manner hereinafter set forth, will provide an electrical signal with a value that varies with the temperature being produced in the oven 14 by the heater means 11.

The control system 10 includes a manually settable potentiometer 22 that can be of the ratiometric type so that the user can adjust the control knob 23 thereof against a suitable temperature indicating dial (not shown) to select a desired temperature that heater means 11 is to maintain in the oven 14,such as 375° F. or the like.

The ratio of resistances thus set at the manually settable potentiometer 22 are compared to ratio of resistances produced at terminal means 24, 25 and 26 of the potentiometer 20 of the control device 16 of this invention by means of a conventional comparator 27. When the comparator 27 determines that the resistance ratios of the devices 22 and 20 are identical, it will produce an electrical signal that will cause a relay 28 to operate in a manner to cause the electrical heater means or element 11 to be disconnected from the power source 21.

Therefore, as long as the temperature in the oven cavity 14 is at the selected temperature of the potentiometer 22, the heater means 11 remains disconnected from the electrical source 21 by the relay 28. However, should the output temperature in the oven cavity 14 fall below the selected temperature setting of the potentiometer 22, such lower output temperature is sensed by the control device 16 of this invention in a manner hereinafter set forth so that the signal being sent by the potentiometer 20 to the comparator 27 causes the comparator 27 to signal the relay 28 to interconnect the electrical source 21 to the heater means 11 until the temperature in the oven reaches the selected temperature. Subsequently, should the output temperature of the heater means 11 in the oven cavity 14 reach or exceed the temperature selected by the potentiometer 22, the comparator 27 causes the relay 28 to disconnect the electrical source 21 from the heater means 11 because the control device 16 has sensed a temperature above the selected temperature of the potentiometer 22 and its potentiometer 20 is sending such signal to the comparator 27 as will be apparent hereinafter.

The control system 10 previously described is substantially the same as the system set forth in the U.S. patent to Willson et al, U.S. Pat. No. 4,323,764, whereby this patent is being incorporated into this disclosure by this reference thereto.

The details of the rod and tube control device 16 of this invention will now be described and reference is made to FIG. 5 wherein it can be seen that the rod and tube temperature sensing unit 17 includes a tube 29 having an open end 30 secured to the housing means 18 and a closed end 31 disposed remote therefrom, the tube 17 being formed from a metallic material that has a relatively large coefficient of thermal expansion in a manner well known in the art. A rod 32, formed of a suitable material having a relatively low coefficient of thermal expansion in a manner well known in the art, is disposed in the tube 17 and has one end 33 disposed against the closed end 31 of the tube 17 and its other end 34 projecting out of the open end 30 of the tube 17 into an internal chamber 35 of the housing means 18 to engage against a threaded adjusting member 36 carried by a switch lever 37 pivotally mounted to the housing means 18 by a pair of opposed ears 38 thereof being received in suitable fulcrum notches 39, FIG. 9, formed in opposed side walls 40 of the housing means 18.

A second switch lever 41 is also pivotally mounted in the chamber 35 of the housing means 18 by having a pair of opposed ears 42 thereof respectively pivotally mounted in fulcrum notches 43 formed in the side walls 40 of the housing means 18, a cross member 44 of the lever 41 being interconnected to a free end 45 of the first lever 37 by a pair of coiled tension springs 46 respectively having their opposed ends 47 and 48 hooked over the cross member 44 of the lever 41 and the free end 45 of the lever 37.

Figure 5:
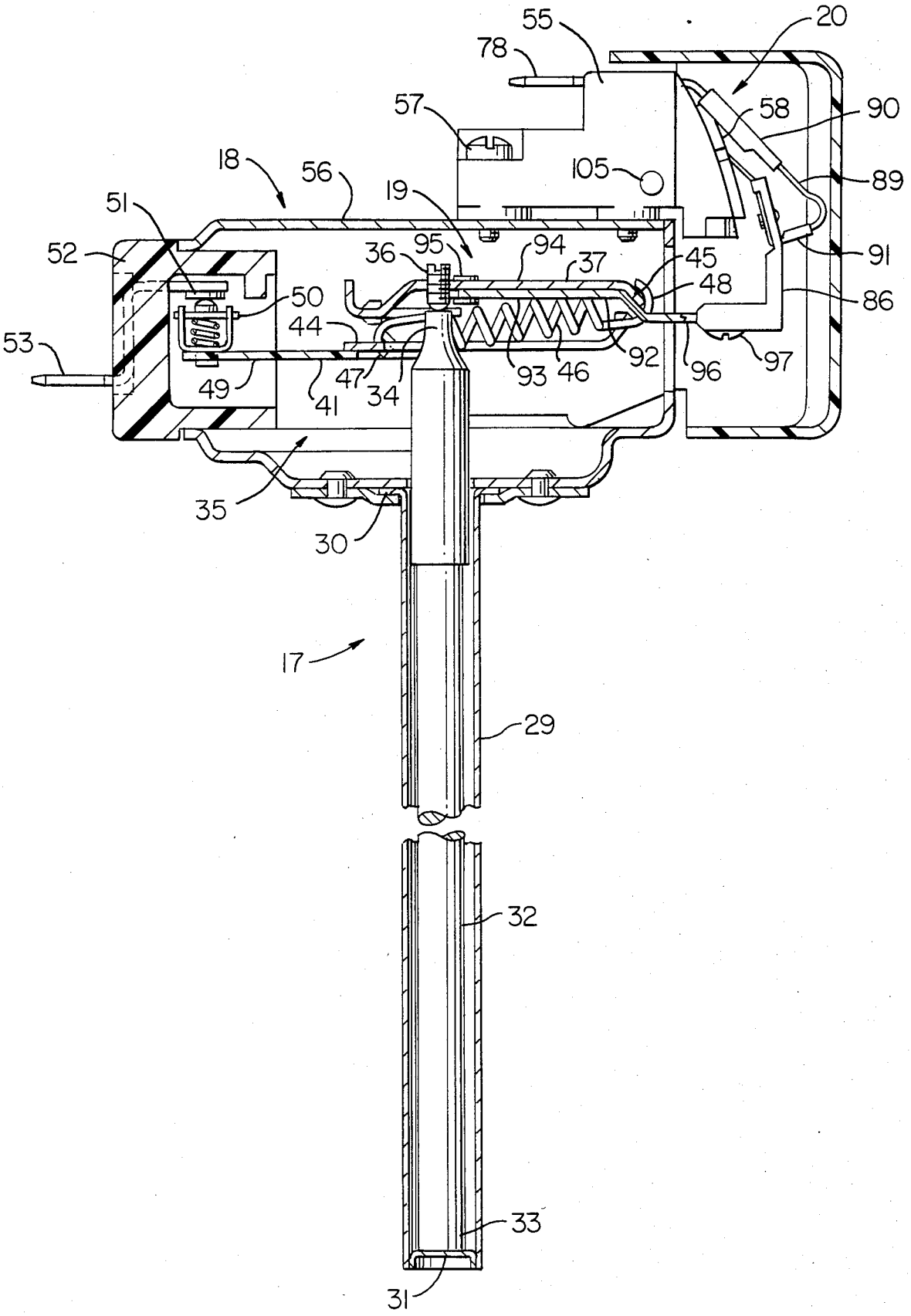
FIG. 5 is a cross-sectional view of the control device of FIG. 3 and is taken in the direction of the arrows 5—5 thereof.

In this manner, the tension springs 46 are under tension between the levers 37 and 41 and normally tend to pivot the lever 37 in a clockwise direction in FIG. 5 about its pivot ears 38 and to pivot the lever 41 also in a clockwise direction in FIG. 5 about its pivot ears 42 so that the free end 49 of the lever 41 normally tends to urge and hold a bridging contact member 50 carried thereon into bridging contact with a pair of spaced apart and fixed contacts 51 carried by a terminal block 52 of the frame means 18 and being respectively interconnected to a pair of terminals 53 and 54 that project out of the terminal block 52 to be interconnected into the control system 10 in the manner illustrated.

The switch lever 37 of the control device 16 tends to follow movement of the end 34 of the rod 32 so that as the temperature being sensed by the rod and tube unit 17 increases, the tube 29 expands relative to the rod 32 and thereby causes the end 34 of the rod 32 to move downwardly in FIG. 5 as the tube 29 substantially linearly expands whereby the lever 37 pivots clockwise in FIG. 5 and causes the free end 45 thereof to move downwardly, such movement of the part 34 of the rod 32 being along a substantially straight linear path.

Should the temperature being sensed by the rod and tube unit 17 exceed the aforementioned predetermined safe temperature for the oven cavity 14, the tube 29 will have elongated in such a manner that the rod end 34 moves downwardly in FIG. 5 to a position that causes the tension springs 46 to move over center and snap the lever 41 downwardly in a counterclockwise direction to move the bridging contact member 50 thereof out of bridging contact with the fixed contacts 51 so that the now opened electrical switch 19 disconnects the electrical source 21 from the heater means 11 and prevents the heater means 11 from operating.

Therefore, it can be seen that the electrical switch 19 of this invention provides a high limit safety function for the cooking apparatus 12 to prevent a run-away high temperature condition in the oven 14 beyond a safe temperature level, the electrical switch 19 being operated by the movable part 34 of the rod and tube temperature sensing unit 17 in the manner previously described and as set forth in the U.S. patent to Hild et al, U.S. Pat. No. 3,419,707 which patent is hereby incorporated by reference into this application by this reference thereto.

The potentiometer means 20 of the control device 16 of this invention includes a block 55 of nonconductive material secured to a top plate 56 of the housing means 18 by fastening members 57, the block 55 carrying a nonconductive member 58 that is adjustable relative thereto along an arcuate path for calibration purposes, as will be apparent hereinafter.

As previously stated, the feature of having the member 58 adjustably carried on the block 55 so as to be adjustable in an arcuate path of movement thereof for calibration purposes forms part of this invention whereas the means for arcuately moving the movable wiper part of the potentiometer means 20 relative to the member 58 does not form part of this invention as the same is being disclosed and claimed in the aforementioned copending patent application, Ser. No. 534,339, filed Sept. 21, 1983, now abandoned, whereby such copending patent application is being incorporated into this disclosure by this reference thereto.

Figure 8:
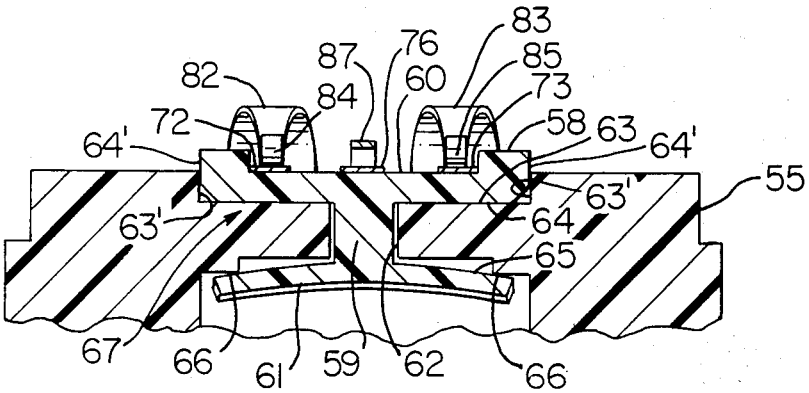
FIG. 8 is a fragmentary cross-sectional view taken on line 8—8 of FIG. 6.

The adjustable member 58 has an H-shaped cross-sectional configuration as illustrated in FIG. 8 and as defined by a cross portion 59 and two parallel parts 60 and 61, the block 55 having a slot means 62 passing therethrough and receiving the cross member 59 of the H-shaped member 58 therein.

Figure 7:
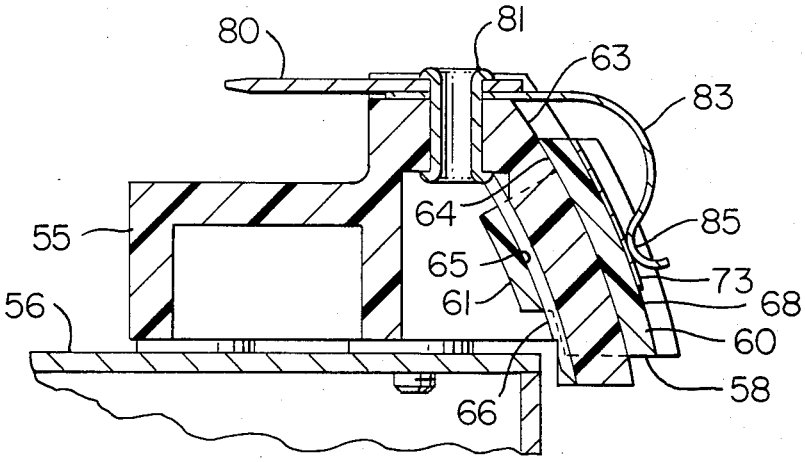
FIG. 7 is a fragmentary cross-sectional view taken on line 7—7 of FIG. 4.

As illustrated in FIG. 7, the block 55 has an arcuate surface 63 against which an arcuate side 64 of the member 58 is disposed in sliding engagement, the part 61 of the H-shaped member 58 also having its arcuate surface 65 disposed against arcuate projections 66 on the block 55 which tend to outwardly bow the part 61 as illustrated in FIG. 8 whereby the bowed part 61 of the member 58 defines biasing means to hold engagement of arcuate surfaces 64 and 63 of members 58 and 55, respectively, and to hold members 58 in its adjusted position in the guide means on the block 55. In particular, the surfaces 63 and 63' as well as arcuate shoulder 66 of the block 55 comprises the guide means of the block 55 that is generally indicated by the reference numeral 67 and against which the H-shaped member 58 cooperates to permit the member 58 to be carried by the block 55 in the manner to be adjustable along an arcuate path for a purpose as will be apparent hereinafter, the surfaces 64' of the member 58 being in close free fit with the surfaces 63' of the block 55.

Figure 6:
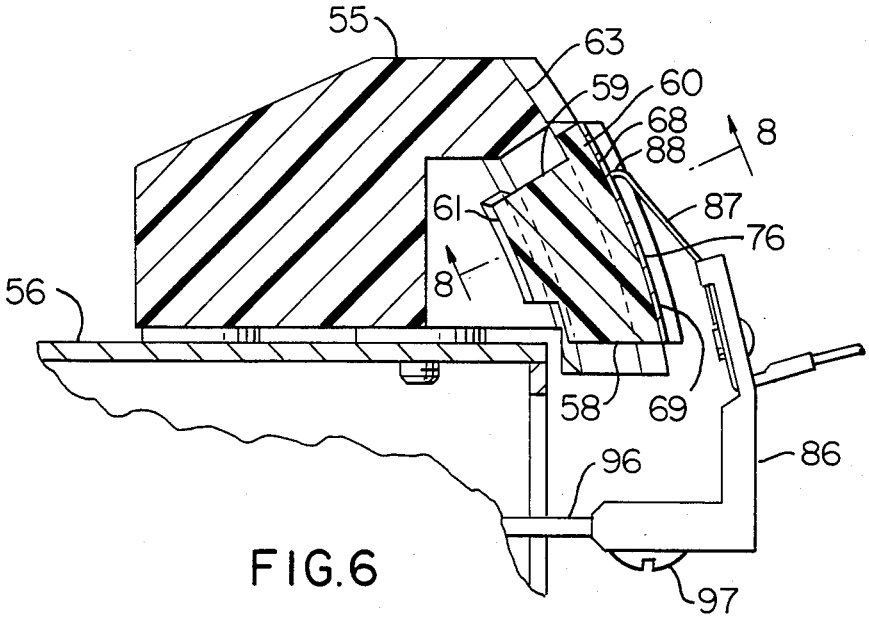
FIG. 6 is a fragmentary cross-sectional view taken on line 6—6 of FIG. 4.

The H-shaped member 58 has a front arcuate surface 68 on which a film strip 69 of electrical resistance means is adhesively secured, as illustrated in FIG. 6, the film 69 being well known in the art and being sold as "RESISTOFILM" by Robertshaw Controls Company, Richmond, Va.

Figure 11:
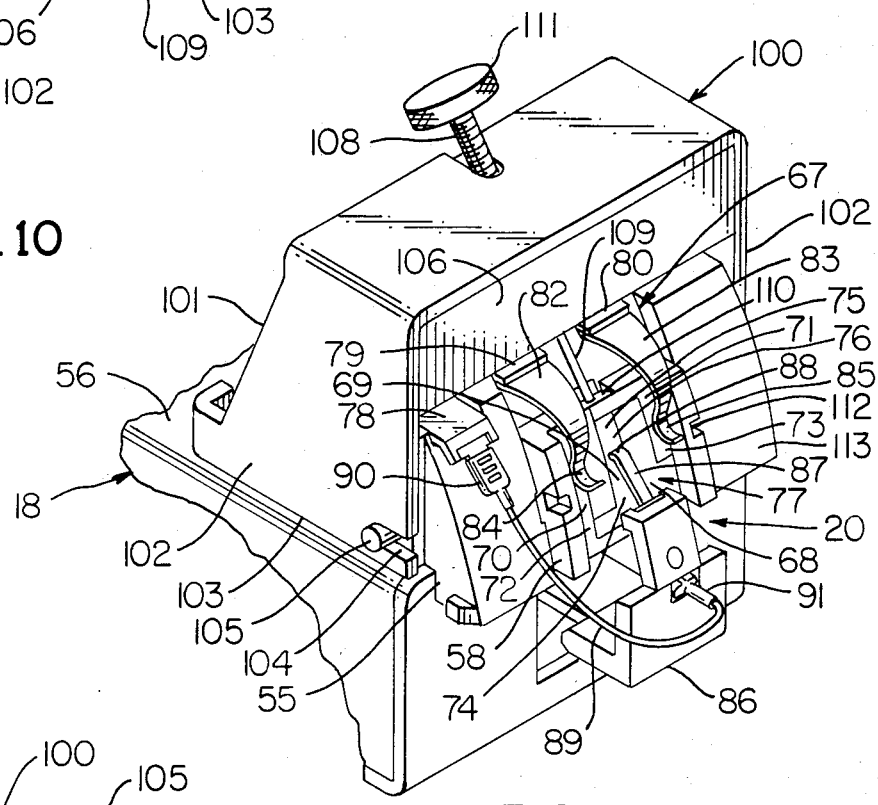
FIG. 11 is a fragmentary perspective view of the calibrating unit of FIG. 10.

As illustrated in FIG. 11, the surface 68 or the film 69 have conductive parts 70 and 71, such as silver, sprayed thereon to define conductive parallel bands 72 and 73, with the bands 72 and 73 being electrically spaced from the film band 76, while being respectively electrically interconnected to ends 74 and 75 of the strip 69 which comprises a narrow band 76 of electrical resistance means against which a movable output means of the potentiometer means 20 is disposed, the movable output means of the potentiometer means 20 being generally indicated by the reference numeral 77 and being hereinafter described.

Figure 4:
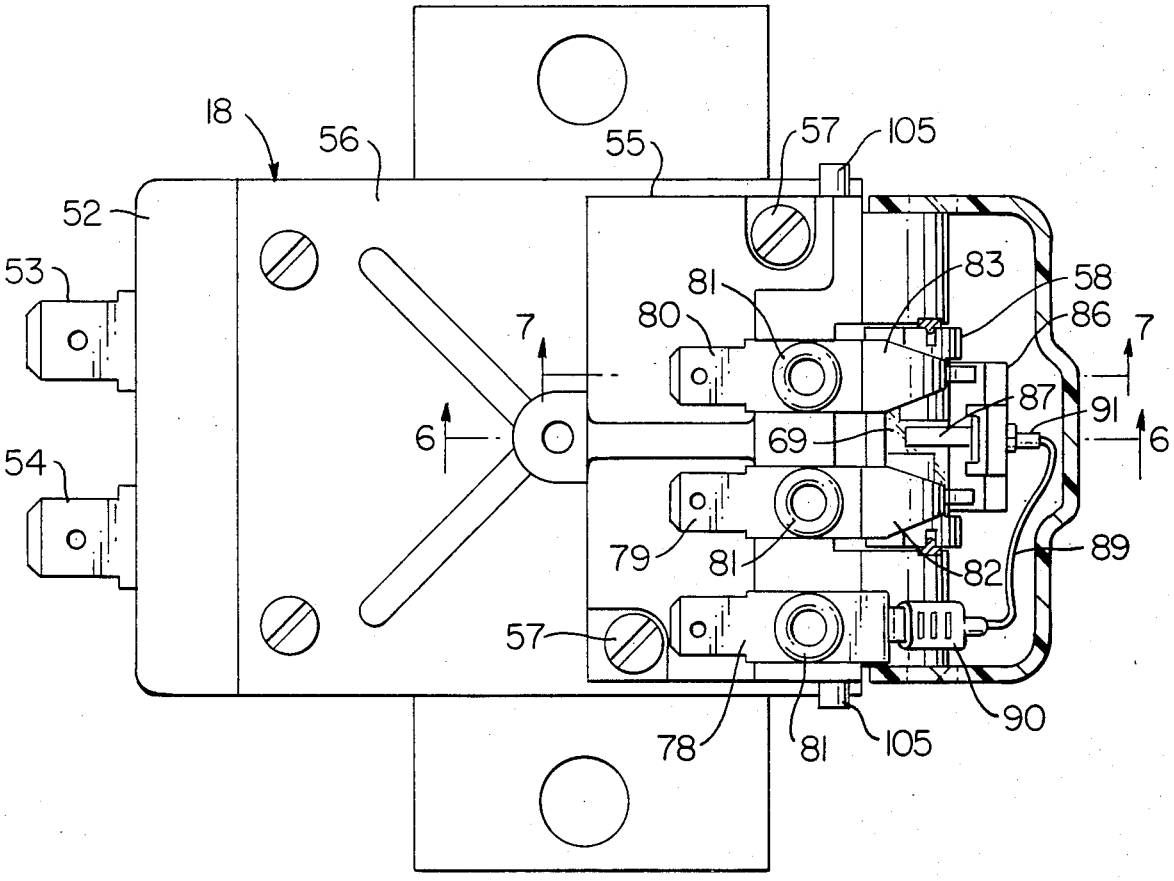
FIG. 4 is a top view of the control device of FIG. 3 with a portion of the casing thereof shown in cross section, FIG. 4 being taken substantially in the direction of the arrows 4—4 of FIG. 3.

Three electrical terminals 78, 79 and 80, FIG. 4, are carried by the block 55 and are secured thereto by suitable rivet means 81 in a manner well known in the art.

The terminals 79 and 80 respectively have flexible conductive members 82 and 83 secured thereto and provided with arcuate portions 84 and 85 respectively bearing against the conductive bands 72 and 73 on the film means 69 as illustrated in FIG. 11 so that the terminals 79 and 80 are always in electrical contact with the portions 72 and 73 regardless of the adjusted position of the member 58 relative to the block 55.

The movable output means 77 of the potentiometer 20 comprises an L-shaped nonconductive member 86 carrying a flexible conductive member or wiper 87 that has an end 88 disposed in sliding engagement with the electrical resistance band 76 of the film 69 as illustrated in FIGS. 6 and 11. A flexible lead 89 has one end 90 electrically interconnected to the terminal 78 while the other end 91 thereof is electrically interconnected to the conductive member 87 so that the terminal 78 is always electrically interconnected to the wiper member 87 which is disposed in sliding engagement with the electrical resistance means 76 of the member 58 between the ends 74 and 75 thereof.

Figure 9:
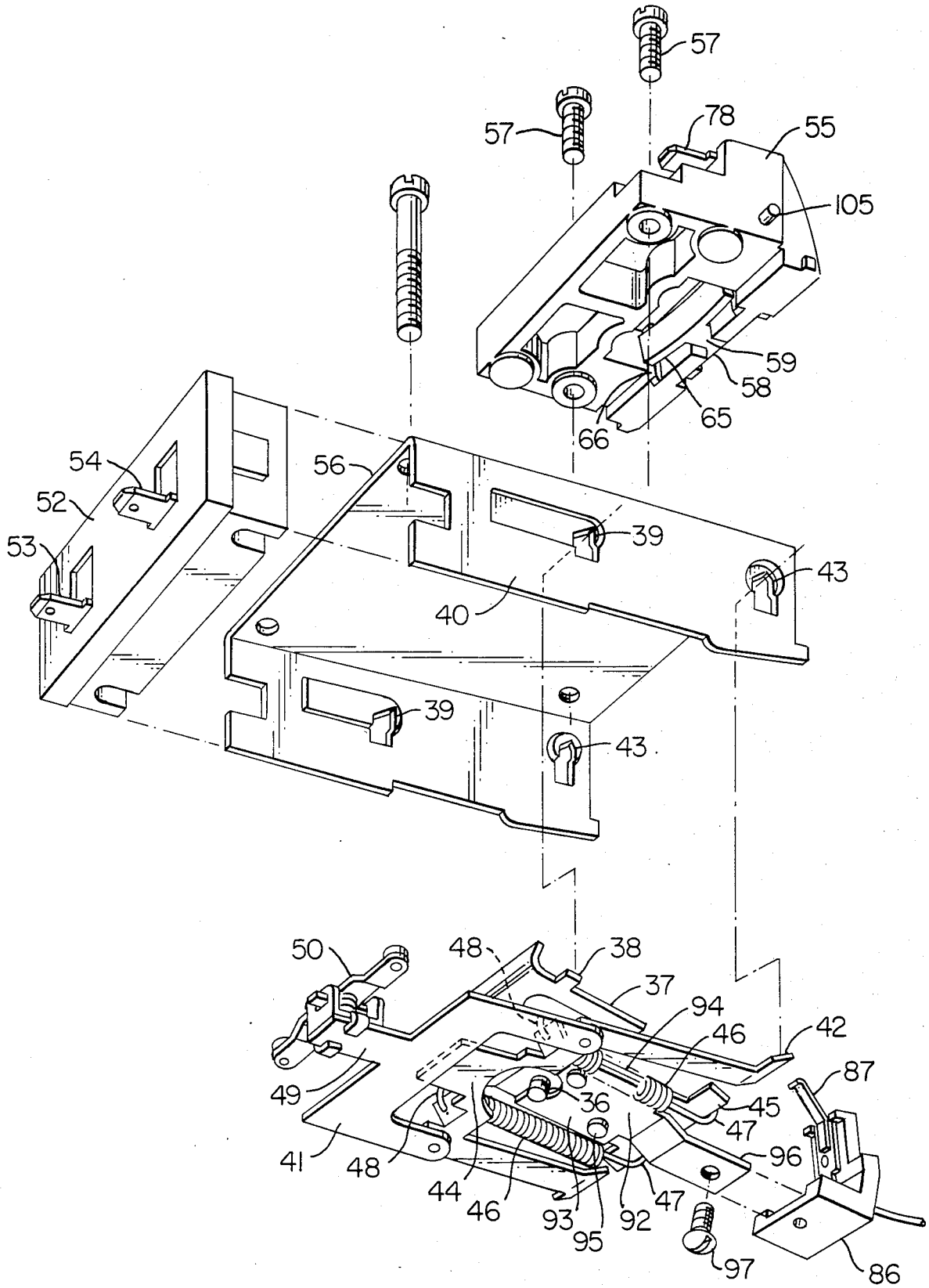
FIG. 9 is an exploded perspective view of certain switch parts of the control device illustrated in FIG. 5.
Figure 10:
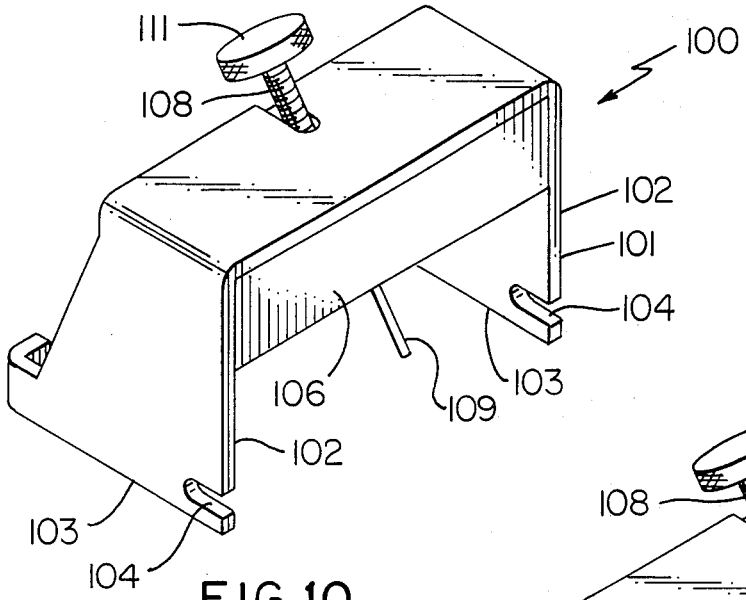
FIG. 10 is a perspective view of a unit for calibrating the control device of FIG. 5.

A rigid arm 92 has one end 93 fastened to a medial portion 94 of the switch lever 37 by fastening means, such as the rivet means 95 illustrated in FIG. 9. The other end 96 of the arm 92 is fastened to the L-shaped member 86 of the output means 77, such as by the fastening means 97 illustrated in FIG. 9, whereby the output means 77 is carried by the lever 37 to move in unison therewith. In this manner, the electrical output producing means 77 is fixed to the switch lever 37 which has its pivot point being the pivot notches 39 in the walls 40 of the housing means 18 whereby the output means 77 pivots about the pivot point of the lever 37.

By making the arcuate surface 68 of the member 58 of the potentiometer means 20 on an arc that is described by a radius that extends from the fulcrum point of the lever 37, and by making the guide means 67 of the block 55 for the member 58 to permit the member 58 to move in an arcuate path that is concentric with the arcuate surface 68 of the member 58, then it can be seen that the end 88 of the electrical output means 77 of the potentiometer means 20 will also move on an arcuate path that is defined by a radius that extends from the pivot point 39 of the lever 37. In this manner, it can be seen that the arcuate path of movement of the electrical output means 77 of the potentiometer means 20 and the substantially straight linear path of movement of the part 34 of the rod and tube temperature sensing unit 17 are disposed substantially coplanar and thereby permits arcuate movement of the part 77 of the potentiometer means 20 as only a single lever arrangement 37, 92 translates the straight line movement of the part 34 of the rod 32 into an arcuate movement of the end 88 of the output means 77 of the potentiometer 20 in a manner believed to be more accurate than the multiple lever arrangement of the rod and tube control device of the aforementioned U.S. patent to Willson, et al, U.S. Pat. No. 4,323,764.

Also, it can be seen that by having the member 58 be adjustable along an arcuate path that is concentric to the arcuate path of movement of the end 88 of the output means 77, the control device 16 can be readily calibrated.

In particular, since the member 58 is adjustable along an arcuate path that is concentric to the arcuate path of movement of the end 88 of the output means 77, movement of the member 58 relative to the end 88 of the output means 77 will change the value of the signal being sent by the potentiometer means 20 without requiring any adjustment of the output means 77 as the same will still move on the same arcuate path that is defined by the resistance band 76 on the arcuate surface 68 of the member 58 regardless of the position of the member 58 on the guide means 67 of the block 55.

Thus, should the temperature sensing unit 17 be sensing a temperature that is exactly 400° F. and the potentiometer 20 is sending a signal that the temperature being sensed is 402° F., the member 58 can be moved downwardly as illustrated in FIG. 6 until the electrical signal being sent by the potentoimeter 20 indicates exactly 400° F. whereby the control device 16 will be accurately calibrated and the arcuate path of movement of the output means 77 of the potentiometer means 20 has not been changed.

Figure 12:
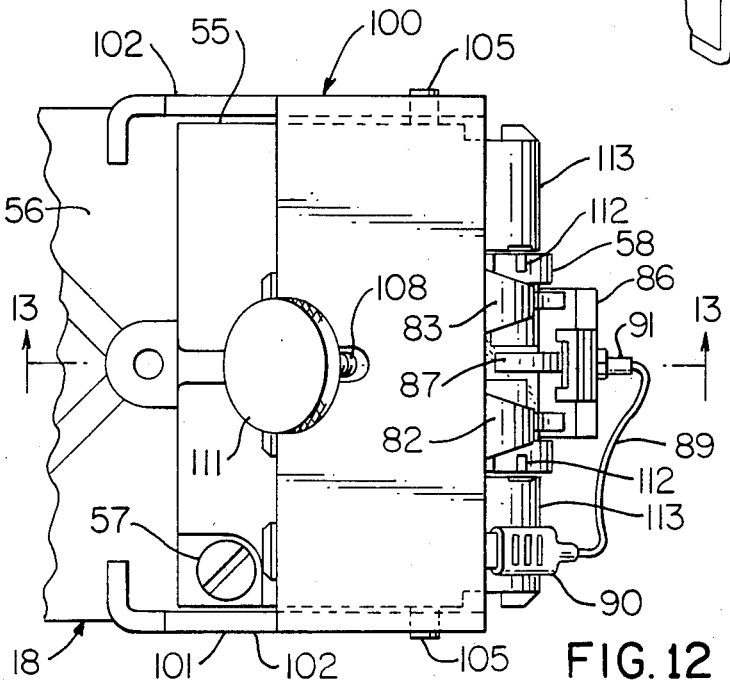
FIG. 12 is a fragmentary top view of the assembly of FIG. 11.

One means for so calibrating or moving the member 58 relative to the block 55 comprises a calibration adapter that is generally indicated by the reference numeral 100 in FIGS. 10–13 and comprises a frame 101 having opposed side wall 102 respectively provided with flat end surfaces 103 and notches or slots 104 whereby the end surfaces 103 of the adapter 100 can be disposed on the top flat surface 56 of the housing means 18 so as to straddle the block 55 therebetween while having outwardly extending abutments 105 of the block 55 received in the notches 104 as illustrated in FIGS. 11 and 12 so as to properly hold the adapter 100 in place on the control device 16.

Figure 13:
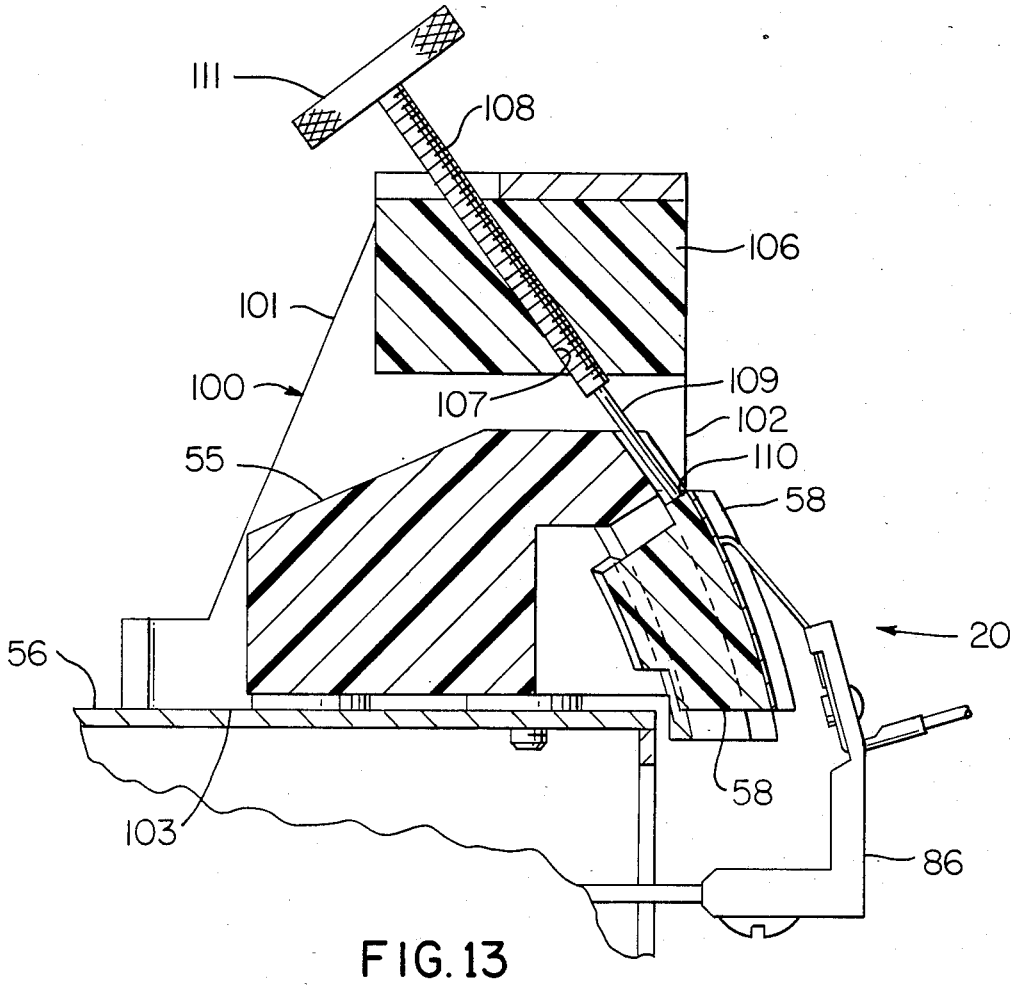
FIG. 13 is an enlarged fragmentary cross-sectional view taken on line 13—13 of FIG. 12.

The frame 101 of the adjusting member or adapter 100 has a cross member 106 provided with a threaded bore 107 angled therethrough and threadedly receiving a threaded adjusting member 108 having an extension 109 for abutting against an end surface 110 of the member 58 of the potentiometer means 20 in the manner illustrated in FIG. 13 so that by rotating the adjusting member 108, such as by turning the enlarged head 111 thereof in the proper direction, the extension 109 of the adjusting member 108 will be moved downwardly as illustrated in FIG. 13 so as to move the member 58 downwardly along the guide means 67 of the block 55 to its proper position as determined by the output signal being directed by the potentiometer 20 in relation to a controlled temperature bath in which the rod and tube temperature sensing unit 17 is disposed in a manner well known in the art for calibrating control devices.

Once the member 58 has been adjusted or calibrated to the proper position thereof so that the potentiometer 20 is providing an accurate signal in relation to the temperature being sensed by the rod and tube temperature sensing unit 17, the member 58 can be fastened in such adjusting position or merely be left alone as the same will be held in its adjusted position by the biasing effect of the bowed part 61 thereof being in frictional engagement against the parts 66 of the block 55.

However, should it be desired to more permanently fasten the member 58 in its now calibrated position, suitable adhesive means can be disposed in notches 112 formed in the opposed sides of the member 58 so as to secure the member 58 to the block 55 at the adjacent surface 113 of the block 55 as illustrated in FIG. 11.

Thus, by initially disposing the member 58 of the potentiometer means 20 in a high temperature signal position thereof, the adapter 100 can be readily utilized to move the member 58 to the correct temperature signal position thereof that corresponds to the control bath temperature for the temperature sensing unit 17 for the particular control device 16 being calibrated.

While one form of adjusting means for adjusting the member 58 relative to the block 55 has been provided in FIGS. 10–13, it is to be understood that other means can be utilized for movement of the member 58 relative to the block 55.

Figure 14:
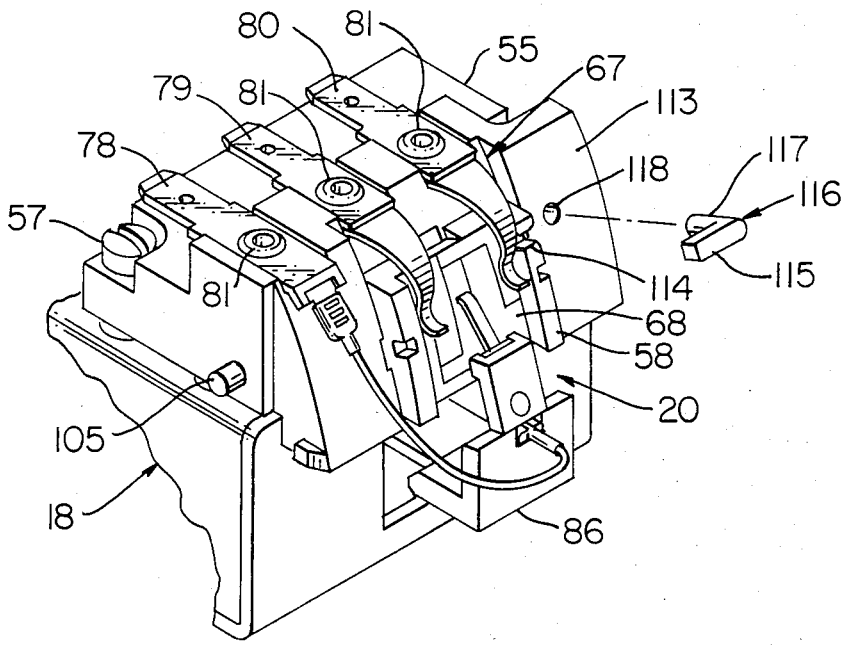
FIG. 14 is a fragmentary perspective view of another embodiment of the control device of this invention.

For example, reference is now made to FIG. 14 wherein the member 58 has a slot 114 formed therein and being adapted to receive a tang 115 of an adjusting tool 116 that also has a cylindrical extension 117 adapted to be received in a cylindrical opening 118 formed in the surface 113 of the block 55 as illustrated in FIG. 14 so that subsequent rotation of the tool 116 in any suitable manner will cause the block 58 to move on its guide means 67 relative to the block 55 depending upon the direction of rotation of the tool 116.

Therefore, it can be seen that the member 58 can be adjusted relative to the block 55 by any suitable adjusting means as the number 58 will be moved in an arcuate path which is concentric with the arcuate surface 68 thereof so that the arm means 37, 92 of the potentiometer means 20 need not be adjusted as the same will still move on the same arc as defined by the surface 68 of the member 58 regardless of its adjusted position on the guide means 67 of the block 55.

While the member 58 has been previously described as having the biasing part 61 thereof being integral and one-piece with the remaining portions 59 and 60 of the member 58, it is to be understood that other biasing means can be provided for the member 58 so that the same will be held in its adjusted position on the guide means 67 of the block 55.

Figure 15:
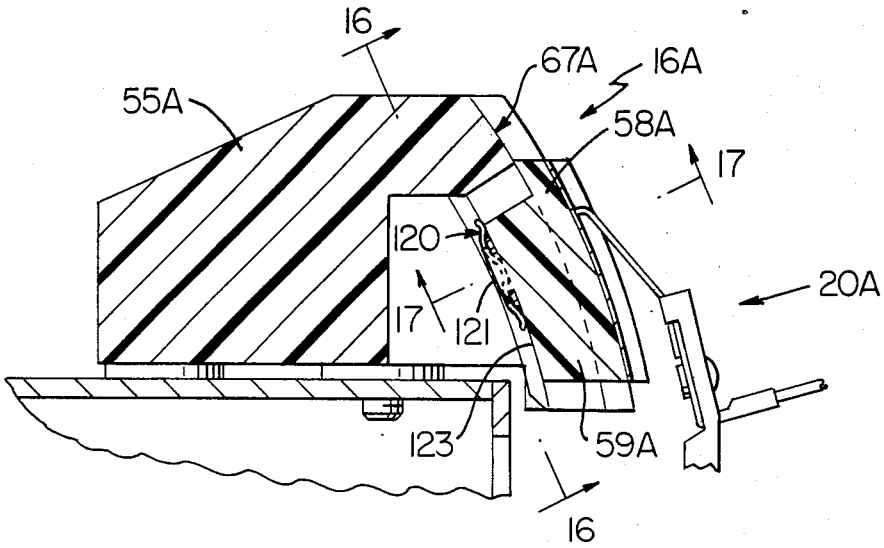
FIG. 15 is a view similar to FIG. 6 and illustrates another embodiment of the control device of this invention.
Figure 16:
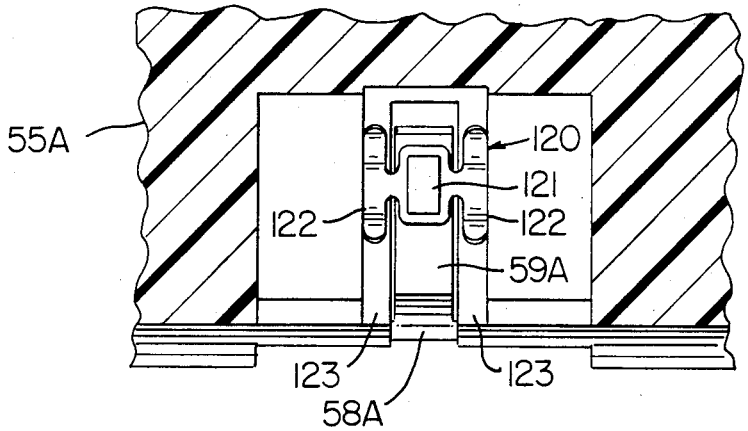
FIG. 16 is a fragmentary cross-sectional view taken on line 16—16 of FIG. 15.
Figure 17:
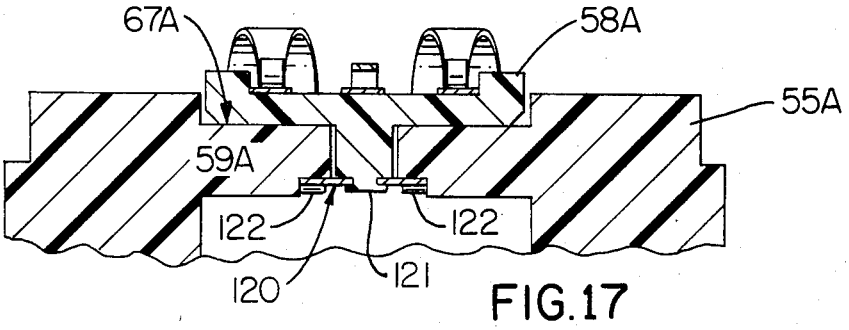
FIG. 17 is a fragmentary cross-sectional view taken on line 17—17 of FIG. 15.

For example, another control device of this invention is generally indicated by the reference numeral 16A in FIGS. 15–17 and parts thereof similar to the control device 16 previously described are indicated by like reference numerals followed by the reference letter "A".

As illustrated in FIGS. 15–17 it can be seen that the control device 16A is substantially identical to the control device 16 previously described except that the adjustable member 58A of the potentiometer means 20A has the part 59A thereof carrying a leaf spring-like member 120 fastened to the end 121 of the part 59A of the member 58A in substantially a rivet-like manner so that parallel side parts 122 of the spring member 120 will bear against cooperating arcuate surfaces 123 on the block 55A with a biasing force as illustrated in FIG. 15 so as to tend to hold the member 58A in its adjusted position in the guide means 67A of the block 55A in substantially the same manner as the biasing part 61 of the previously described member 58 for the control device 16.

Therefore, it can be seen that it is a relatively simple method of this invention to make the control device 16 (or control device 16A) in such a manner that the substantially straight linear path of movement of the part 34 of the rod 32 of the temperature sensing unit 17 is translated by the single lever means 37, 92 into an arcuate path of movement of the end 88 of the electrical output means 77 of the potentiometer means 20 with such arcuate path of movement and substantially straight line path of movement being disposed substantially coplanar and with the arcuate surface 68 being defined by a radius extending from the fulcrum point of the lever 37, which point in the embodiment illustrated in the drawings is a point midway between the fulcrum notches 39 of the casing member 18, such method of this invention permitting the resulting potentiometer means 20 of the control device 16 to be readily calibrated in the manner previously described.

The operation of the control system 10 utilizing the control device 16 of this invention will now be described.

Assuming that the user of the cooking apparatus 12 desires that the cooking temperature in the oven cavity 14 should be 400° F., the user turns the knob 23 of the potentiometer 22 from the "off" position thereof to its 400° F. setting so that the potentiometer 22 will provide an electrical signal to the comparator 27 that would be of the same value as the value of a signal being supplied to the comparator 27 by the potentiometer 20 of the control device 16 when the rod and tube unit 17 is sensing 400° F. in the oven cavity 14.

Therefore, initially when the potentiometer 22 is set at 400° F. and the oven cavity 14 is at room temperature, the rod and tube unit 17 has the movable end 34 of the rod 32 in such a position that the end 88 of the wiper arm 87 is positioned on the resistive means 76 in such a manner that the signal being sent by the potentiometer 20 to the comparator 27 causes the comparator 27 to operate the relay 28 in a manner to interconnect the power source 21 to the heating element 11. The heating element 11 is maintained interconnected to the power source 21 as long as the temperature in the oven cavity 14 is below the selected 400° F. However, as the temperature in the oven 14 increases from room temperature toward 400° F., the rod end 34 moves downwardly in FIG. 5 as the tube 29 elongates through the increased heating thereof so that the lever 37 moves in a clockwise direction in FIG. 5 under the force of the tension springs 46 and thereby causes the wiper arm 87 to have its wiper end 88 moved downwardly in FIG. 6 to change the output signal of the potentiometer 20 in such a manner that the value of the output signal reflects the temperature being sensed by the rod and tube temperature sensing unit 17.

Therefore, when the temperature of the oven cavity 14 reaches 400° F., or slightly above the same, the signal being sent by the potentiometer 20 to the comparator 27 matches the signal being sent by the potentiometer 22 to the comparator 27 so that the comparator 27 will now cause the relay means 28 to disconnect the heater element 11 from the power source 21 and will again cause the relay 28 to interconnect the power source 21 to the heating element 11 when the temperature in the oven cavity falls below the selected temperature 400° F. a certain amount.

In this manner, the comparator 27 effects a cycling on and off of the heater means 11 in a manner to tend to maintain the temperature in the oven cavity 14 at the temperature that had been selected by the setting of the potentiometer 22.

As previously stated, if for some reason, the heating element 11 should continue to operate and cause the temperature in the oven cavity 14 to not only exceed the selected temperature but reach an unsafe high temperature level, above the preset clean temperature of approximately 950° F., the movable part 34 of the rod 32 has been moved downwardly in FIG. 5 a sufficient distance to cause the free end 45 of the lever 37 to move the tension springs 46 over center and thereby snap the lower lever 41 in a counterclockwise direction in FIG. 5 so that the bridging contact member 50 thereof separates from the fixed contacts 51. Such opening of the electrical switch 19 causes the electrical source 21 to be disconnected from the heating element 11. In this manner, it can be seen that the temperature in the oven cavity 14 cannot exceed an unsafe high temperature should other parts of the control system 10 malfunction for any reason and cause an adverse run-away temperature situation.

Therefore, it can be seen that not only does the control device 16 of this invention combine the dual function of operating the high limit electrical switch 19 for the control system 10 and generate an analog electrical signal for control purposes, so as to reduce the total system costs by combining the two functions which were separately provided in certain prior known systems, but also the use of a rod and tube temperature sensing unit 17 for this purpose has many other advantages.

In particular, a rod and tube unit can average temperature over a wider area than most high temperature sensors. A rod and tube unit provides a fast response time because its high movement portion can be in direct contact with the heated oven cavity. A rod and tube unit can be made from a wide variety of materials to tailor its performance of its environment. For example, stainless steel and ceramic for high temperature operation and copper and Invar rod for greater movement and sensitivity.

The combination control device 16 of this invention can sense high temperature while keeping electrical connections out of the high temperature area as the housing portion 18 is disposed outside the oven cavity 14 as illustrated in FIG. 1. This overcomes a major weakness of most high temperature sensors.

The electrical output of the control device 16 of this invention can be linear and by using the potentiometer 20 as a transducer, the output can be configured to suit various control strategies. For example, a potentiometer transducer can be used in a ratiometric configuration to have a linear voltage signal that provides better accuracy.

Also, a rod and tube sensor is an extremely reliable device so that the chance that it would fail is almost negligible. This is also true of the switch mechanism and contacts that operate from the rod and tube unit and is especially true since the switch 19 in the control system 10 of this invention is used as a limit control and operates only in the case of failure of some other part of the system 10.

It should be understood that additional electrical switches can be added to the control device 16 to perform other functions as desired.

Therefore, it can be seen that this invention not only provides an improved control system and control device therefor, but also this invention provides improved methods of making such a control device.

While the forms and methods of this invention now preferred have been illustrated and described as required by the Patent Statute, it is to be understood that other forms and method steps can be utilized and still fall within the scope of the appended claims.

What is claimed is:

1. In a control device having a rod and tube temperature sensing unit for providing linear motion of a part thereof along a substantially straight linear path in relation to the temperature being sensed by said unit and having a potentiometer means provided with an electrical output producing means operatively interconnected to said part of said unit so as to produce a variable electrical signal in relation to the temperature being sensed by said unit, said electrical output means being movable along an arcuate linear path by said part of said unit, said potentiometer means having a member provided with an arcuate electrical resistance means having a wiper contacting face, said electrical output means comprising an electrical wiper means being disposed in sliding engagement with said wiper contacting face whereby said arcuate electrical resistance means defines said arcuate path, said control device having movable interconnecting means operatively interconnecting said part of said unit to said electrical output means of said potentiometer means, said movable interconnecting means comprising a pivotally mounted lever, said lever having a pivot point, said electrical output means being carried by said lever to move in unison therewith whereby said arcuate path is defined by a radius extending from said pivot point of said lever to said electrical output means of said potentiometer means, the improvement wherein said linear path of said electrical output means and said linear path of said part of said unit are substantially coplanar and said wiper contacting face of said potentiometer means is convex and is also defined by a radius extending from said pivot point of said lever to said wiper contacting surface of said potentiometer means and wherein said member is movable relative to said device along an arcuate path that is substantially concentric to said arcuate path of said electrical output means for calibrating said device.

2. A control device as set forth in claim 1 wherein said control device has guide means, said member of said potentiometer means having means operatively associated with said guide means to provide for said arcuate path of movement thereof.

3. A control device as set forth in claim 2 wherein said member of said potentiometer means has biasing means operatively associated with said guide means to tend to hold said member in its adjusted relation on said guide means.

4. A control device as set forth in claim 3 wherein said guide means defines a slot means, said member having a substantially H-shape with the cross member thereof being disposed in said slot means.

5. A control device as set forth in claim 4 wherein one of the parallel parts of said H-shaped member defines said biasing means thereof.

6. A control device as set forth in claim 1 wherein said member has a convex outer surface, said electrical resistance means comprising a resistance film secured to said convex outer surface to define said convex wiper contacting face of said member.

7. In a method of making a control device, said method comprising the steps of forming said device to have a rod and tube temperature sensing unit for providing linear motion of a part thereof along a substantially straight linear path in relation to the temperature being sensed by said unit and to have a potentiometer means provided with an electrical output producing means operatively interconnected to said part of said unit so as to produce a variable electrical signal in relation to the temperature being sensed by said unit, forming said electrical output means to be movable along an arcuate linear path by said part of said unit, forming said potentiometer means to have a member provided with an arcuate electrical resistance means having a wiper contacting face, disposing an electrical wiper means of said electrical output means in sliding engagement with said wiper contacting face whereby said arcuate electrical resistance means defines said arcuate path, forming said control device to have a movable interconnecting means operatively interconnecting said part of said unit to said electrical output means of said potentiometer means, forming said movable interconnecting means to comprise a pivotally mounted lever, forming said lever to have a pivot point, and forming said electrical output means to be carried by said lever to move in unison therewith whereby said arcuate path is defined by a radius extending from said pivot point of said lever to said electrical output means of said potentiometer means, the improvement comprising the steps of forming said control device so that said linear path of said electrical output means and said linear path of said part of said unit are substantially coplanar and said wiper contacting face of said potentiometer means is convex and is also defined by a radius extending from said pivot point of said lever to said wiper contacting surface of said potentiometer means, and forming said member to be movable relative to said device along an arcuate path that is substantially concentric to said arcuate path of said electrical output means for calibrating said device.

8. A method of making a control device as set forth in claim 7 and including the steps of forming said control device to have guide means, and operatively associating said member of said potentiometer means with said guide means to provide for said arcuate path of movement thereof.

9. A method of making a control device as set forth in claim 8 and including the step of forming said member of said potentiometer means with biasing means that is operatively associated with said guide means to tend to hold said member in its adjusted relation on said guide means.

10. A method of making a control device as set forth in claim 9 and including the step of forming one of the parallel parts of said H-shaped member to define said biasing means thereof.

11. A method of making a control device as set forth in claim 7 and including the step of forming said surface means of said member of said potentiometer means to comprise an electrical resistance means carried by said member.

12. A method of making a control device as set forth in claim 7 and including the steps of forming said member to have a convex outer surface, forming said electrical resistance means to comprise a resistance film, and securing said film to said convex outer surface of said member to define said convex wiper contacting face of said member.

13. In a control system for a heating means that has control means for comparing a variable electrical signal that has a value in relation to the output temperature of said heating means and a selected electrical signal that has a value in relation to a selected temperature setting to control the operation of said heating means to tend to produce an output temperature substantially equal to said selected temperature, said control means comprising a control device having a rod and tube temperature sensing unit for providing linear motion of a part thereof along a substantially straight linear path in relation to the output temperature of said heating means and having a potentiometer means provided with an electrical output producing means operatively interconnected to said part of said unit so as to produce a variable electrical signal in relation to the output temperature of said heating means, said electrical output means being movable along an arcuate linear path by said part of said unit, said potentiometer means having a member provided with an arcuate electrical resistance means having a wiper contacting face, said electrical output means comprising an electrical wiper means being disposed in sliding engagement with said wiper contacting face whereby said arcuate electrical resistance means defines said arcuate path, said control device having a movable interconnecting means operatively interconnecting said part of said unit to said electrical output means of said potentiometer means, said movable interconnecting means comprising a pivotally mounted lever, said lever having a pivot point, said electrical output means being carried by said lever to move in unison therewith whereby said arcuate path is defined by a radius extending from said pivot point of said lever to said electrical output means of said potentiometer means, the improvement wherein said linear path of said electrical output means and said linear path of said part of said unit are substantially coplanar and said wiper contacting face of said potentiometer means is convex and is also defined by a radius extending from said pivot point of said lever to said wiper contacting surface of said potentiometer means and wherein said member is movable relative to said device along an arcuate path that is substantially concentric to said arcuate path of said electrical output means for calibrating said device.

14. A control system as set forth in claim 13 wherein said control device has guide means, said member of said potentiometer means having means operatively associated with said guide means to provide for said arcuate path of movement thereof.

15. A control system as set forth in claim 14 wherein said member of said potentiometer means has biasing means operatively associated with said guide means to tend to hold said member in its adjusted relation on said guide means.

16. A control system as set forth in claim 15 wherein said guide means defines a slot means, said member having a substantially H-shape with the cross member thereof being disposed in said slot means.

17. A control system as set forth in claim 16 wherein one of the parallel parts of said H-shaped member defines said biasing means thereof.

18. A control system as set forth in claim 13 wherein said member has a convex outer surface, said electrical resistance means comprising a resistance film secured to said convex outer surface to define said convex wiper contacting face of said member.

* * * * *